United States Patent [19]

Carman et al.

[11] 4,139,226

[45] Feb. 13, 1979

[54] ANTI-PILFERAGE LATCHING DEVICE

[75] Inventors: Richard W. Carman, Alexandria, Va.; Glen D. Larsen, Upper Marlboro, Md.

[73] Assignee: Southern Railway Company, Washington, D.C.

[21] Appl. No.: 840,220

[22] Filed: Oct. 7, 1977

[51] Int. Cl.[2] ..... E05C 19/08

[52] U.S. Cl. ..... 292/285; 292/210; 292/DIG. 46

[58] Field of Search ..... 292/DIG. 46, DIG. 22, 292/DIG. 32, 285, 286, 108, 210, 44, 54

[56] References Cited

U.S. PATENT DOCUMENTS

| | | | |
|---|---|---|---|
| 956,281 | 4/1910 | Buckius, Jr. | 292/286 |
| 1,111,599 | 9/1914 | Martineau et al. | 292/285 |
| 1,992,734 | 2/1935 | Bittorf | 292/285 X |
| 2,194,641 | 3/1940 | Daniels | 292/54 X |
| 3,599,743 | 8/1971 | Hull | 292/216 |
| 3,933,384 | 1/1976 | Schuller et al. | 292/DIG. 32 |

*Primary Examiner*—Richard E. Moore
*Attorney, Agent, or Firm*—Watson, Cole, Grindle & Watson

[57] ABSTRACT

A device for latching a sliding door member in place against a stationary frame structure includes an elongated hasp mountable on the door and engageable with a keeper secured to a bracket on the frame with which the hasp engages preventing it from moving laterally outwardly. A pair of cam elements are pivotally mounted on the bracket for movement about a common axis above the hasp, and have flat end surfaces directly overlying an end edge of the hasp for latching it against vertical upward movement. A stop pin on the bracket below such common axis engages with the cam elements for permitting one of them to pivot in only one direction while permitting the other cam element to pivot in only an opposite direction so that the hasp remains latched against vertical upward movement by one or the other of the cams even when subjected to forces having a tendency to cause the cams to pivot in either such direction.

5 Claims, 4 Drawing Figures

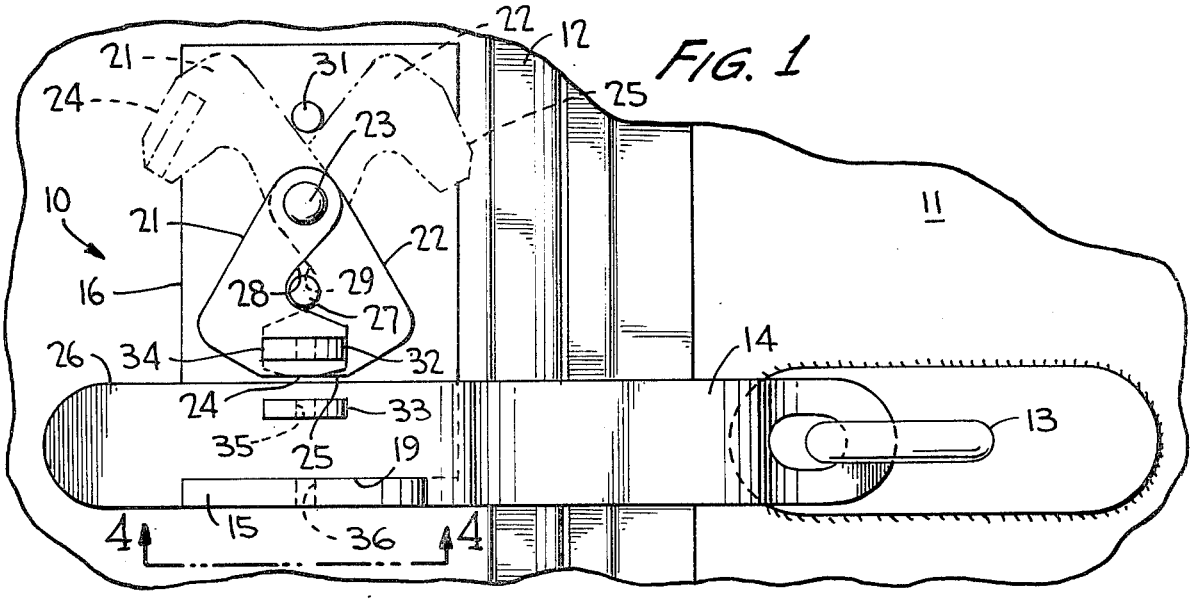
FIG. 1
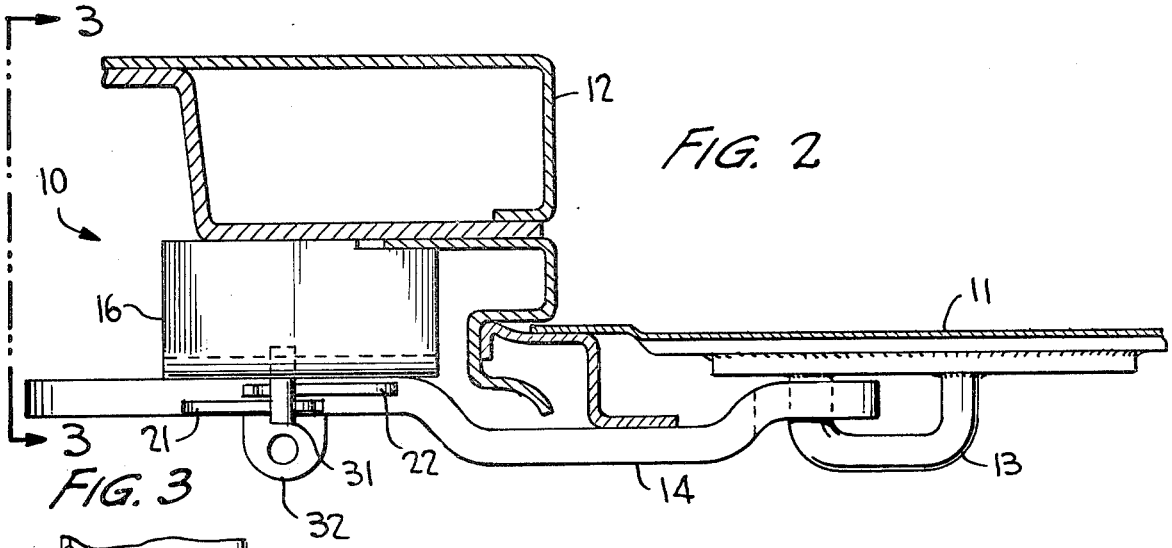
FIG. 2
FIG. 3
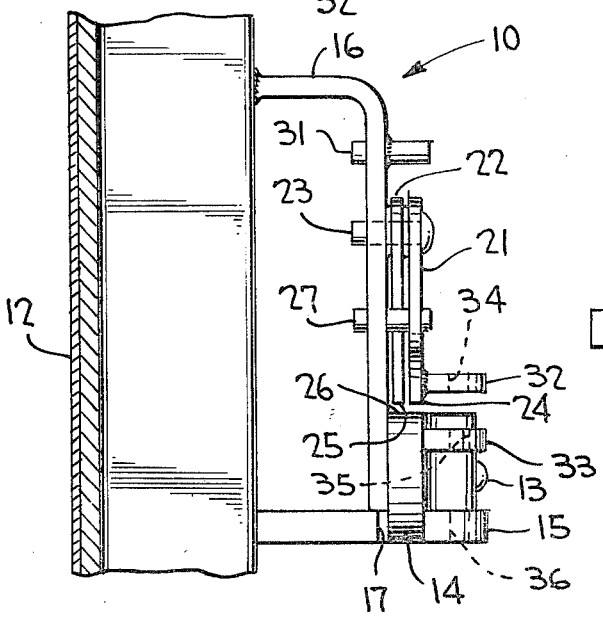
FIG. 4
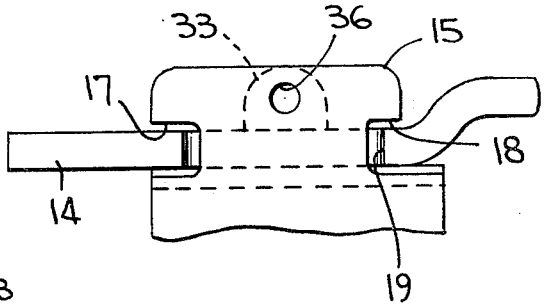

ANTI-PILFERAGE LATCHING DEVICE

BACKGROUND OF THE INVENTION

This invention relates generally to a latching device for railway car doors, and more particularly to such a device as having a hasp latched against vertical upward movement by a pair of cams regardless of the forces to which the device is subjected tending to cause the cams to rotate out of a latching position.

U.S. Pat. No. 3,933,384 to Schuller et al relates to an anti-pilferage locking device including a hasp used for latching a longitudinally sliding member in place against a stationary frame structure, the hasp being mounted on the door and being engageable with a flange provided on a keeper mounted on the bracket located on the frame structure. A single cam element is mounted on the keeper for pivotal movement above the hasp, and has a flat lower horizontal edge engageable with an edge of the hasp so as to limit vertical movement thereof. Locking means may also be provided for locking the cam and hasp in place.

The disadvantage with such an arrangement is that the cam element, when serving as a latch without the lock means being used, may easily unlatch and permit disengagement of the hasp upon an application of a force tending to pivot the cam away from the hasp. Such a force may occur as a result of impact between adjoining railway cars. And, if the cam is pivoted out of its latching position, a vertical impact could easily disengage the hasp from the keeper. A need therefore arises to avoid inadvertent unlatching of the device in the presence of normal forces to which the railway car is subjected, and also to render the device more difficult to unlatch by unauthorized personnel.

SUMMARY OF THE INVENTION

It is therefore an object of the present invention to improve upon the anti-pilferage device of U.S. Pat. No. 3,933,384 by providing a latching device which avoids the inherent problems of such a prior art device although is easy to assemble and manufacture and is simple and efficient in its operation.

Another object of this invention is to provide such device which cannot easily be unlatched in the presence of longitudinal forces acting to pivot the cam device heretofore used out of its latching position.

In carrying out these overall objectives, the device according to the invention is similar to the device disclosed in the aforementioned U.S. Pat. No. 3,933,384 patent except that a pair of cam elements are provided in lieu of a single cam, such cam elements being mounted for pivotal movement about a common axis above the hasp and having flat lower end surfaces directly overlying an end edge of the hasp for locking it against vertical upward movement. A stop pin on the keeper is located between the cams for permitting one of them to pivot in only one direction when its lower end surface overlies the end edge of the hasp, and permits the other cam element to pivot in only an opposite direction when its lower end surface overlies the end edge of the hasp. Thus, the hasp remains latched against vertical upward movement even in the presence of forces tending to cause the cam elements to pivot in such one and in such opposite directions. Only one cam will pivot in such one direction and only the other cam will pivot in such opposite direction so that one of the two cams will always overlie the hasp for latching it against vertical upward movement.

Other objects, advantages and novel features of the invention become more apparent from the following detailed description of the invention when taken in conjunction with the accompanying drawings.

BRIEF DESCRIPTION OF THE DRAWINGS

FIG. 1 is a side elevational view of the anti-pilferage latching device according to the invention;

FIG. 2 is a top plan view of the FIG. 1 device;

FIG. 3 is an end elevational view of the device taken along line 3—3 of FIG. 2; and FIG. 4 is a bottom plan view taken substantially along line 4—4 of FIG. 1 and showing the hasp latched against lateral outward movement.

DETAILED DESCRIPTION OF THE INVENTION

Turning now to the drawings wherein like reference characters refer to like and corresponding parts throughout the several views, the latching device according to the invention is generally designated 10 and is especially useable for latching a sliding door 11 of a railway box car in place against a stationary structure such as frame post 12. The door is mounted for longitudinal sliding movement toward and away from post 12, and typically has a link member 13 mounted thereon engageable by one end of an elongated hasp or locking bar 14. The door is latched against an opening away from the post as the hasp engages a keeper in the form of a laterally extending flange 15 mounted to the post at the lower end of the bracket 16 which is likewise mounted to the post. Flange 15 has cutouts 17 and 18 at opposite side edges thereof, and the hasp has a notch 19 in a lower edge thereof permitting the hasp to engage the notches of flange 15 in such a manner as to avoid outward lateral movement relative thereto (FIGS. 1 and 4).

The latching device further includes a pair of cam elements 21 and 22 mounted on a pin 23, secured to bracket 16, for pivotal movement about the central axis thereof. As shown in FIG. 1, each cam element is substantially L-shaped and is pivotally mounted in place at an upper end thereof. The lower ends of the cam elements have flat surfaces 24 and 25 which together overlie the upper end edge 26 of the hasp (see FIG. 3). The relative thicknesses of the cam elements and the hasp are such that one of surfaces 24 and 25 will always directly overlie edge 26 regardless of one of the cam elements being swung outwardly away from the hasp, as will be brought out more clearly hereinafter.

A stop in 27 is fixedly secured to bracket 16 and extends laterally outwardly thereof a sufficient distance as to interfere with the cam elements. This stop pin is disposed for engagement with the confronting inner edges 28 and 29 of the cam elements so as to prevent cam element 21 from pivoting counter-clockwise, as in FIG. 1, beyond its position at which its surface 24 lies parallel to edge 26 of the hasp. Likewise, stop pin 27 prevents cam element 22 from rotating clockwise, as in FIG. 1, beyond its position wherein its surface 25 lies parallel to edge 26 of the hasp. Another stop pin 31 is fixedly mounted on bracket 16 and likewise extends laterally outwardly a sufficient distance to interfere with the cam elements. This stop pin, as shown in FIG. 1, is provided for preventing clockwise rotation of cam 21 beyond substantially 180° as the stop pin engages the rear edge of cam 21, shown in phantom outline in this Figure. Cam 22 is likewise shown in phantom outline in FIG. 1 in a position wherein its rear edge engages stop pin 31 so as to prevent this cam element from rotating counter-clockwise beyond pin 31. Limitation of the rotational movements of the cam elements in such manner avoids any possibility of the rear edges of the cams engaging stop pin 27 which would, as can be appreciated, defeat the purpose intended for the present device since surfaces 24 and 25 of the cams would not lie parallel to edge 26 in such an improper cam position.

Laterally extending flanges 32 and 33 are respectively mounted on cam element 21 and on the hasp and, together with flange 15, have axially aligned apertures 34, 35 and 36 for the reception of the shank of a bolt lock (not shown) to thereby positively lock the hasp in place.

From the foregoing it can be seen that a simple and economical yet highly effective anti-pilferage latching device has been developed including a dual cam feature which assures that at least one cam will remain against the hasp such that, if a cable seal or other locking device is not used for locking the hasp in place, the integrity of the device will remain in tact regardless of longitudinal impact which might tend to dislodge the cam of a single cam device and thus allow the hasp or locking bar to become disengaged.

Obviously, many modifications and variations of the present invention are made possible in light of the above teachings. It is therefore to be understood that within the scope of the appended claims, the invention may be practiced otherwise than as specifically described.

We claim:

1. In a device for latching a longitudinally sliding member in place against a stationary structure wherein the device includes an elongated hasp mountable on said member and engageable with a keeper mounted on a vertically disposed bracket which is securable to said structure, the improvement comprising:

said keeper comprising a flange extending laterally outwardly thereof and having means thereon engageable with said hasp for preventing said hasp from moving laterally outwardly thereof when engaged;

a pair of cam elements mounted on said bracket for pivotal movement about a common axis in vertical alignment with said flange;

said cam elements being disposed above an end edge of said hasp and having flat lower end surfaces directly overlying said end edge for latching said hasp against vertical upward movement;

said cam elements being substantially L-shaped and wholly lying in planes parallel to said hasp, legs of said elements facing one another and defining an opening therebetween when said end surfaces directly overlie said end edge; and one stop pin on said bracket engageable with inner edges of said cam elements and extending through said opening therebetween so as to permit one of said cam elements to pivot about said axis in only one direction when said end surface thereof overlies said end edge, and permitting the other of said cam elements to pivot about said axis in only another direction opposite said one direction when said end surface thereof overlies said end edge, whereby said hasp remains latched against said vertical upward movement even when said cams are subjected to forces having a tendency to cause said cam elements to pivot in said one direction and in said opposite direction.

2. The device according to claim 1, wherein said one cam element has a laterally extending flange thereon, vertically aligned apertures in said flanges being provided for the reception of locking means.

3. The device according to claim 2, wherein a laterally extending flange is provided on said hasp and has an aperture therein vertically aligned with said aforementioned apertures for the reception of the locking means.

4. The device according to claim 1, wherein said flange has cutouts at opposite side edges thereof, and said hasp has a downwardly open notch therein engageable with said flange at said cutouts.

5. The device according to claim 1, wherein another stop pin is mounted on said bracket above said common axis for limiting pivotal movement of said one cam element in said one direction, and for limiting pivotal movement of said other cam element in said opposite direction.

* * * * *